US005558063A

United States Patent [19]

Minagawa et al.

[11] Patent Number: 5,558,063

[45] Date of Patent: Sep. 24, 1996

[54] FUEL SUPPLY SYSTEM WITH TWO-STAGE CONTROL PRESSURE REGIONS

[75] Inventors: Kazuji Minagawa, Tokoname; Kiyotoshi Oi, Toyohashi; Takashi Akiba, Kariya, all of Japan

[73] Assignee: Nippondenso Co., Ltd., Kariya, Japan

[21] Appl. No.: 535,632

[22] Filed: Sep. 28, 1995

[30] Foreign Application Priority Data

Oct. 11, 1994 [JP] Japan ..... 6-245530

[51] Int. Cl.[6] ..... F02M 41/00; F02M 37/04

[52] U.S. Cl. ..... 123/457; 123/497

[58] Field of Search ..... 123/510, 511, 123/497, 457, 458, 459, 461, 514, 516; 137/510, 529

[56] References Cited

U.S. PATENT DOCUMENTS

| | | | |
|---|---|---|---|
| 3,862,751 | 1/1975 | Schwaller | 137/529 |
| 4,635,606 | 1/1987 | Koike et al. | 123/459 |
| 4,825,903 | 5/1989 | Ochs et al. | 137/529 |
| 5,035,223 | 7/1991 | Watanabe | 123/459 |
| 5,069,111 | 12/1991 | Loffler et al. | 137/529 |
| 5,237,975 | 8/1993 | Betki et al. | 123/456 |
| 5,265,644 | 11/1993 | Tuckey | 137/510 |
| 5,359,976 | 11/1994 | Nakashima et al. | 123/516 |

FOREIGN PATENT DOCUMENTS

| | | |
|---|---|---|
| 62-162767 | 7/1987 | Japan . |
| 5-500099 | 1/1993 | Japan . |

*Primary Examiner*—Thomas N. Moulis
*Attorney, Agent, or Firm*—Cushman, Darby & Cushman

[57] ABSTRACT

A fuel supply system for an engine comprises a fuel pump for supplying fuel to fuel injectors, a pump controller which increases the fuel delivery flow rate from the fuel pump during hot restarting or high load running of the engine and a pressure regulator disposed in a fuel supply passage between the fuel pump and the injectors for adjusting the fuel supply pressure at which fuel is supplied to the injectors. The pressure regulator adjusts the fuel supply pressure according to an excess fuel flow rate of fuel returned to the fuel tank from the pressure regulator to a low-pressure side control pressure region over a first excess fuel flow rate range and to a high-pressure side control pressure region over a second excess fuel flow rate range. Based on simple electronic control of the fuel pump the pressure regulator keeps the fuel supply pressure in the high-pressure side control pressure region during hot restarting and high load running of the engine and thereby suppresses the arrival of fuel vapor at the injectors and improves the hot restarting and high load running characteristics of the engine.

14 Claims, 5 Drawing Sheets

FUEL SUPPLY SYSTEM WITH TWO-STAGE CONTROL PRESSURE REGIONS

CROSS REFERENCE TO RELATED APPLICATION

This application is based on and claims priority of Japanese Application No. 6-245530 filed on Oct. 11, 1994, the content of which is incorporated herein by reference.

BACKGROUND OF THE INVENTION

1. Field of the Invention

This invention relates to a fuel supply system for an internal combustion engine (hereinafter, referred to as engine).

2. Description of Related Art

There have been fuel supply systems which keep fuel supplied by a fuel pump to fuel injectors at a predetermined pressure by means of a pressure regulator disposed in a fuel supply passage leading from the fuel pump to the injectors.

An example of a conventional pressure regulator of a fuel supply system of this kind, such as disclosed in JP-A-62162767, is shown in FIG. 8. Referring to FIG. 8, a pressure regulator 110 comprises a diaphragm 113 clamped at a boundary between a first case 111 and a second case 112. The central portion of the diaphragm 113 is gripped between a valve part and a spring receiver 114, and the diaphragm 113, the valve part 120 and the spring receiver 114 reciprocate integrally. The valve part 120 is urged in a valve-closing direction by a compression coil spring 115.

A spring chamber 111*a* inside the first case 111 is connected to an air intake pipe not shown in the figure by a connecting pipe 116, and the spring chamber 111*a* is thereby set at an air intake pipe negative or vacuum pressure. An inlet pipe 131 through which fuel is introduced into a fuel chamber 112*a* from a fuel tank not shown in the figure and a return pipe 132 through which excess fuel is returned to the fuel tank are connected to the second case 112.

The valve part 120 displaces to a position such that the air intake pipe negative pressure of the spring chamber 111*a*, the fuel pressure of the fuel chamber 112*a* and the urging force in the valve-closing direction of the compression coil spring 115 are in equilibrium. When fuel is introduced from the fuel pump, the valve part 120 lifts according to the fuel delivery flow rate from the fuel pump and a valve-opening area formed between a valve body 121 and a seat member 122 changes in size and adjusts an excess fuel flow rate of fuel returned to the fuel tank through the return pipe 132 and as a result the fuel pressure in the fuel chamber 112*a* is kept constant.

However, in the fuel supply system using the pressure regulator shown in FIG. 13, when after the engine is stopped the engine is restarted again while it is still hot, vapor arises in the fuel in the supply passage from the fuel pump to the injectors. When this fuel including vapor is supplied to the injectors the fuel injection quantity decreases and consequently the engine may not start well or may not start at all.

To solve this kind of problem, in a fuel supply system disclosed in the international (PCT) patent application, Publication No. H5-500099, the fuel delivery flow rate from the fuel pump is made adjustable according to the fuel flow rate demand from the engine. When the return flow rate of fuel from the pressure regulator is between $Q_{min}$ and $Q_{max}$, a control pressure, that is, the pressure at which fuel is supplied to the injectors, is kept constant as shown in FIG. 9. The control pressure can be increased by increasing the fuel delivery flow rate from the fuel pump so that the return flow rate exceeds $Q_{max}$. In this way, because during hot restarting of the engine it is possible to raise the control pressure by increasing the fuel delivery flow rate from the fuel pump, the production of vapor caused by the high temperature can be suppressed by increasing the pressure of the supplied fuel.

However, in this conventional fuel supply system, in the control pressure range over which the occurrence of vapor can be suppressed, the control pressure varies greatly depending on the return flow rate of fuel, i.e., on the fuel delivery flow rate from the fuel pump. Consequently, control of the control pressure is difficult and there has been the problem that, when the fuel supply flow rate to the injectors varies, the air/fuel ratio fluctuates. Also, there is a likelihood of fuel leakage from the fuel piping occurring due to the control pressure increasing too much.

Besides this, there have been [1] apparatuses which suppress the occurrence of vapor by raising the valve-opening pressure of the pressure regulator when the engine is stopped or when the fuel pump is stopped; [2] apparatuses which suppress the occurrence of vapor by providing a passage cutoff valve in an outlet of a fuel supply pipe and closing this passage cutoff valve and thereby closing the fuel supply passage when the engine is stopped; [3] apparatuses which suppress the occurrence of vapor by providing two pressure regulators, one for low pressure and one for high pressure; and [4] apparatuses which operate two fuel pumps and forcibly discharge vapor into the return pipe.

In the fuel supply systems described in [1] to [4] above, with those in which excess fuel is returned to the fuel tank by a return pipe, because the construction is complicated and hot fuel is returned to the fuel tank, there has been the problem that the temperature of the fuel in the fuel tank rises and evaporation tends to occur.

As proposed in Nakashima U.S. Pat. No. 5,359,976, a fuel supply system is being considered wherein to alleviate this the excess fuel return pipe is dispensed with, all connectors through which fuel is distributed from the fuel supply pipe to the injectors of engine cylinders are extended to an upper part of the fuel supply pipe, the fuel inlet openings of the injectors open into this upper part of the fuel supply pipe, a branched fuel pipe is disposed from the upstream side of the fuel supply pipe to the upper part of the fuel supply pipe, the fuel pump is connected to the fuel supply pipe by a connecting constriction and as a result vapor having arisen does not directly affect the fuel injection quantity during engine starting. However, this apparatus will also has a likelihood that the fuel supply piping is complex and large.

SUMMARY OF THE INVENTION

It is therefore an object of the present invention to solve these kinds of problems.

It is a further object of the present invention to provide a fuel supply system with which the hot restarting characteristics of the engine are good and control is easy.

It is a still further object of the present invention to provide a fuel supply system having two-stage control pressure regions, one for normal engine operation and the other for hot engine restarting operation.

In a fuel supply system according to one aspect of the present invention, at each of low-pressure side and high-pressure side control pressure regions of a pressure regulator, a flat control pressure region is provided so that the control pressure varies with respect to an excess fuel return flow rate at less than 0.1 kgf/cm$^2$/10 liters/hr, for example, during hot restarting or high-load running. By keeping the fuel supply pressure at a high constant pressure, the occurrence of vapor due to the high temperature of the engine can be easily suppressed with a simple construction.

Preferably, the fuel supply passage from the pressure regulator to the injectors is closed, that is, excess fuel is not returned to the fuel tank from the fuel supply passage between the pressure regulator and the injectors, and therefore hot fuel is not returned to the fuel tank. As a result, because increasing of the temperature of the fuel inside the fuel tank is thereby suppressed, the occurrence of evaporation due to increasing of the temperature of the delivered fuel can be suppressed.

Preferably, by disposing the pressure regulator inside the fuel tank, excess fuel can be returned to the fuel tank before becoming hot. As a result, because it is possible to suppress increasing of the temperature of the fuel inside the fuel tank, evaporation due to increasing of the temperature of the delivered fuel can be further suppressed.

Preferably, the difference in pressure between the low-pressure side and high-pressure side flat control pressure regions is made at least 0.5 kgf/cm$^2$. This makes it possible to prevent an excessive load being put on the fuel pump during normal running, when the fuel supply pressure is controlled on the low-pressure side, and therefore fuel consumption improves and it is possible to improve the reliability of the fuel piping.

Preferably, the pressure of the high-pressure side flat control pressure region is made over 3 kgf/cm$^2$, whereby the occurrence of vapor can be effectively prevented.

In a pressure regulator according to another aspect of the present invention, two fuel pressures can be supplied according to the excess fuel flow rate. Furthermore, by both a first pressure and a second pressure being supplied over predetermined regions of displacement of a pressure-receiving member, the first pressure or the second pressure is supplied stably even if the excess fuel flow rate fluctuates in the respective region. As a result, even when for example during hot restarting of the engine the fuel pressure is brought to the second pressure because the fuel pressure applied is stably adjusted to the second pressure by the pressure regulator, even during starting the fuel supply flow rate to the engine can be accurately adjusted to the desired value.

DETAILED DESCRIPTION OF THE PREFERRED EMBODIMENTS

Preferred embodiments of the invention will now be described in detail with reference to the accompanying drawings.

(First Preferred Embodiment)

Figure 1:
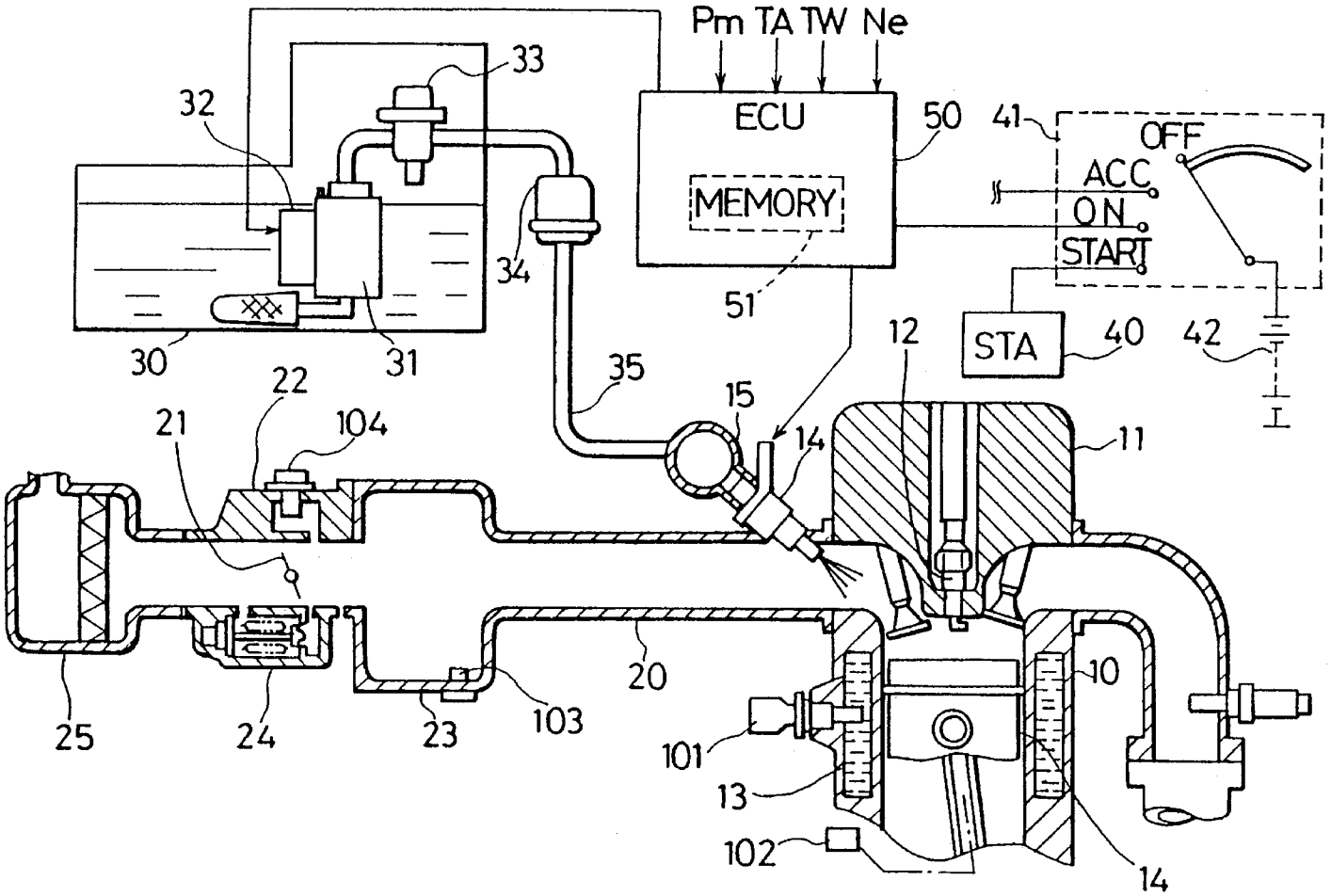
FIG. 1 is a schematic view showing an example of a fuel supply system according to a first preferred embodiment applied to a fuel injector apparatus.

A first preferred embodiment of a fuel supply system according to the invention applied to a fuel injection system of an internal combustion engine is shown in FIG. 1.

An engine body 10 of a multi-cylinder engine has a spark plug 12 for each cylinder disposed in a cylinder head 11. Pistons 14 are reciprocatably disposed in cylinders of a cylinder block 13, and a water temperature sensor 101 for detecting the temperature of cooling water circulating in the engine proper 10 is mounted on the cylinder block 13. A crankshaft not shown in the figure is provided with a rotational angle sensor 102 which outputs a detection signal every certain crank angle.

A throttle body 22 housing a throttle valve 21 which opens and closes according to depression of an accelerator pedal not shown in the figure is disposed in the upstream side of an air intake pipe 20 connected to the engine body 10. A surge tank 23 is disposed on the downstream side of the throttle body 22, and an intake air temperature sensor 103 for detecting the temperature of intake air is disposed in the surge tank 23. An idling speed control valve (ISC valve) 24 for controlling the amount of air bypassing the throttle valve 21 during idling and an intake air pressure sensor 104 for detecting the pressure of intake air are disposed in the throttle body 22. Injectors 14 for injecting fuel into the combustion chambers are disposed in the downstream side of the air intake pipe 20, and a fuel supply pipe 15 is connected to the injectors 14.

Fuel to be supplied to the injectors 14 is pumped from a fuel tank 30 by a fuel pump 31. The fuel pump 31 is housed inside the fuel tank 30, and fuel is supplied to the fuel supply pipe 15 from a pressure regulator 33 inside the fuel tank via a fuel filter 34 and a fuel pipe 35. A pump controller 32 controls the fuel delivery flow rate or quantity by adjusting the electric power at which an electric motor of the fuel pump 31 is driven according to the fuel flow rate demand from the engine body 10. The pressure inside the fuel supply pipe 15 is kept at a predetermined pressure by the pressure regulator 33. Of the fuel pumped up by the fuel pump 31, excess fuel is returned from the pressure regulator 33 into the fuel tank 30.

A supply of electric current from a battery 42 to a starter motor 40 for rotating the crank shaft during starting of the engine body 10 is switched ON and OFF by means of a key switch 41. The key switch 41 is turnable between the four positions OFF, ACC, ON and START, and when the key switch 41 is turned from OFF to ACC by means of a key not shown in the figure electricity is supplied from the battery 42 to head-lights, a radio and the like. When the key switch 41 is further turned to ON, electricity is supplied from the battery 42 to an electronic control unit (ECU) 50. When the key switch 41 is further turned to START, electricity is also supplied from the battery 42 to the starter motor 40.

The ECU 50 starts operating when electricity is supplied to it from the battery 42 and inputs detection signals of the water temperature TW, the engine speed Ne, the intake air temperature TA and the intake air pressure Pm respectively from the water temperature sensor 101, the rotational angle sensor 102, the intake air temperature sensor 103 and the intake air pressure sensor 104. According to these inputted signals, the ECU 50 outputs driving signals to the injectors 14 and the pump controller 32. The ECU 50 also has a memory 51 for storing detected values from the various sensors and calculated results.

Figure 2:
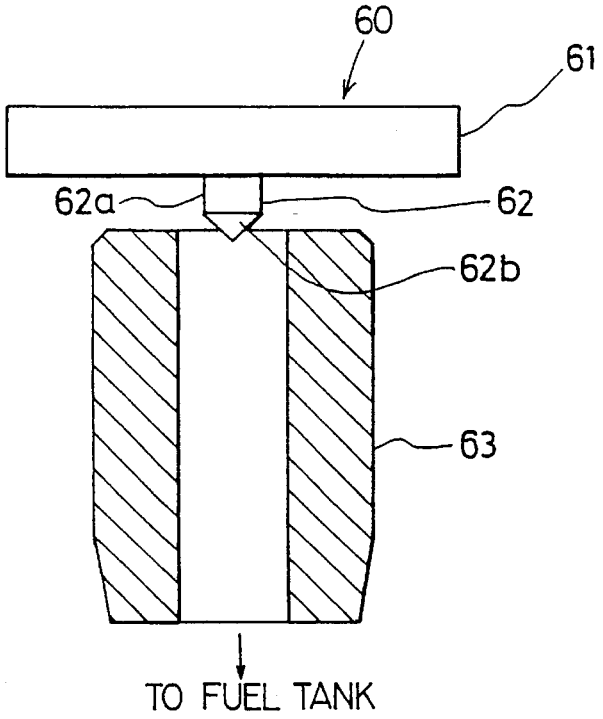
FIG. 2 is a schematic view of a main part of a pressure regulator of a fuel supply system according to the first preferred embodiment of the invention.
Figure 8:
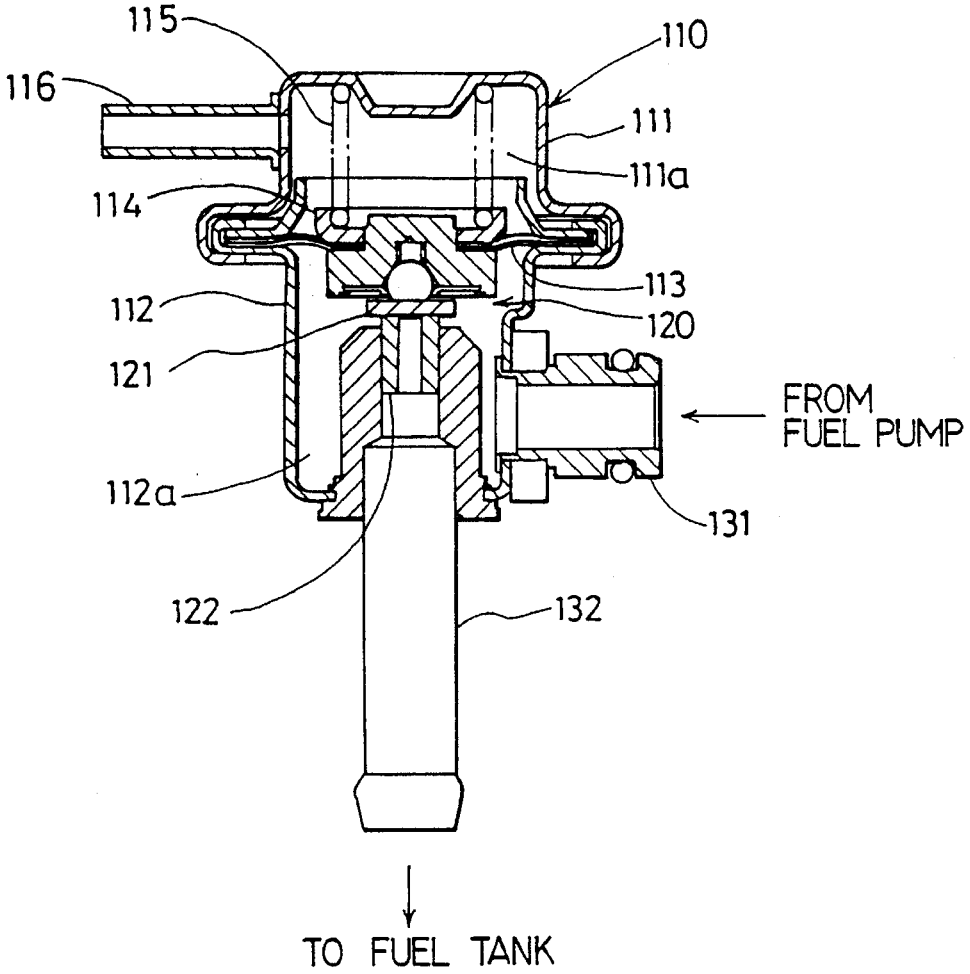
FIG. 8 PRIOR ART
FIG. 8 is a sectional view showing a pressure regulator of a conventional fuel supply system.
Figure 9:
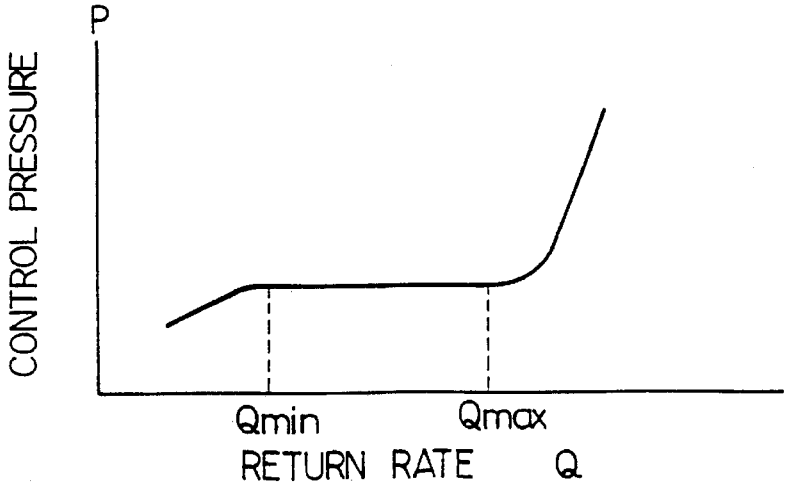
FIG. 9 PRIOR ART
FIG. 9 is a characteristic graph showing a relationship between return flow rate and control pressure of a conventional pressure regulator.

Apart from the shape of a valve body, the internal construction of the pressure regulator 33 is essentially the same as that of the conventional one shown in FIG. 8. The valve body 60 shown in FIG. 2 is made up of a cylindrical flat disk plate 61 and a projection 62 projecting from a side of the flat plate 61 facing a seat member 63. The projection 62 is made up of a cylindrical portion 62*a* and a conical portion 62*b*. By the valve body 60 being lifted by the pressure of fuel delivered from the fuel pump 31 and returning excess fuel to the fuel tank 30, the pressure regulator 33 keeps the control pressure, that is the fuel supply pressure to the injectors 14, at a constant pressure.

Next, the operation of the pressure regulator 33 will be described with reference to FIGS. 3A, 3B, 3C, 4 and 5.

Figure 3A:
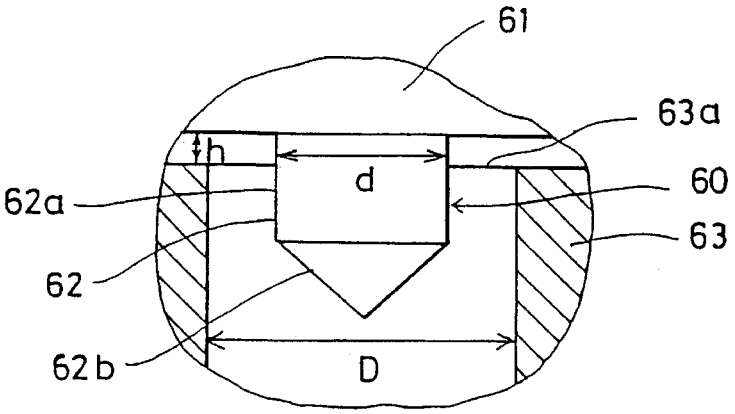
FIGS. 3A, 3B and 3C are schematic sectional views showing lift positions of a valve body of the first preferred embodiment.

When the engine is started and fuel is delivered from the fuel tank 30, the valve body 60 lifts as shown in FIG. 3A. Because the valve-opening area S of the valve body 60 is limited by the minimum flow passage area, in the initial stage shown in FIG. 3A of the lifting of the valve body 60, the side area of a cylinder of diameter D formed between the flat plate 61 and the seat member 63 is smaller than the annular valve-opening area formed between the peripheral edge of the opening 63*a* of the seat member 63 and the projection 62. In other words, the valve-opening area S at this time is given by the following expression (1), and as shown between "o" and "a" in FIG. 4 the valve-opening area S increases in proportion with the degree of lift of the valve body 60.

$$S=\pi Dh \tag{1}$$

Figure 5:
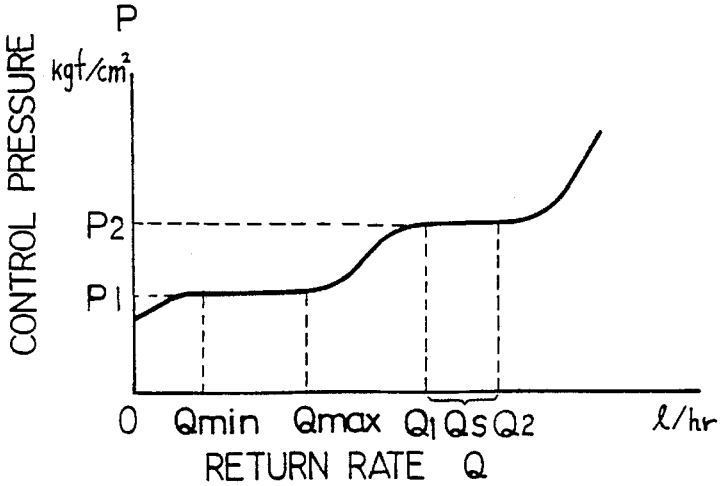
FIG. 5 is a characteristic graph showing a relationship between return flow rate and control pressure of the pressure regulator of the first preferred embodiment.

At this time, as shown in FIG. 5, when the control pressure of the pressure regulator 33 leaves an unstable region in the vicinity of Q=0 (where Q is the excess fuel return flow rate), in the range $Q_{min}$ to $Q_{max}$ of the return fuel flow rate from the pressure regulator 33 the control pressure of the pressure regulator 33 is at a low-pressure side and substantially constant first pressure P1. In the return flow rate range $Q_{min}$ to $Q_{max}$ wherein this first pressure P1 is realized, if the gradient of the pressure in the flat control pressure range shown in FIG. 5 with respect to a return flow rate differential of 10 liters/hr is less than 0.1 kgf/cm$^2$/10 liters/hr, good injector fuel injection quantity control accuracy can be maintained.

Figure 3B:
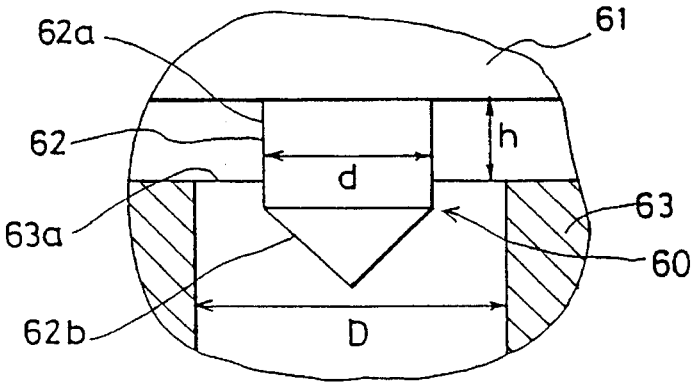

When the valve body 60 lifts further, as shown in FIG. 3B, while the conical portion 62*b* is still inside the seat member 63, the annular valve-opening area becomes larger than the above-mentioned cylindrical side area. The annular valve-opening area is expressed by the following expression (2):

$$S=\pi(D^2-d^2)/4 \tag{2}$$

Figure 4:
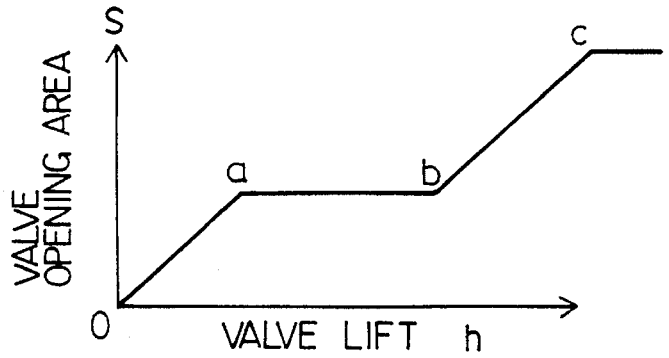
FIG. 4 is a characteristic graph showing a relationship between degree of valve lift and valve-opening area in a pressure regulator of the first preferred embodiment.

That is, as shown between "a" and "b" in FIG. 4, the valve-opening area S is constant. As a result, when the fuel delivery flow rate from the fuel tank 30 increases so that the return flow rate exceeds $Q_{max}$, as shown in FIG. 5 the control pressure increases.

Figure 3C:
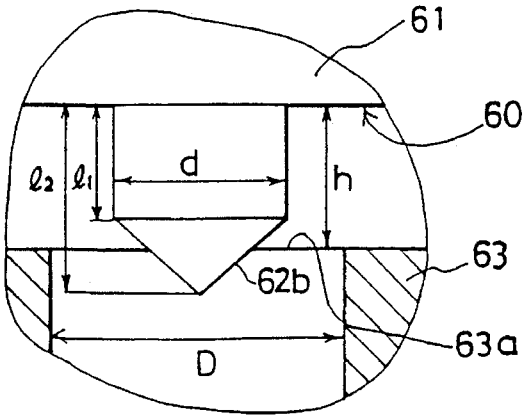

As shown in FIG. 3C, when the valve body 60 lifts further and the boundary between the cylindrical portion 62*a* and the conical portion 62*b* moves above the opening 63*a*, along with lifting of the valve body 60 the cylindrical opening area increases and is given by the following expression (3):

$$S=\pi\{D^2-d^2(1-(h-l_1)/(l_2-l_1))^2\}/4 \tag{3}$$

That is, the valve-opening area S also increases as shown between "b" and "c" in FIG. 4, and in the return flow rate range shown as Qs between Q1 and Q2 in FIG. 5 the control pressure is at a high-pressure side and substantially constant second pressure P2. As on the low-pressure side, if the amount of variation in the high-pressure side constant pressure value is less than 0.1 kgf/cm$^2$/10 liters/hr, good injector fuel injection quantity control accuracy can be maintained, and the fuel injection quantity can be kept to the required quantity with high accuracy even during hot restarting. Also, the high-pressure side constant pressure value is over 3 kgf/cm$^2$ and more than 0.5 kgf/cm$^2$ different from the low-side constant pressure value.

During normal running the valve body 60 is in the position shown in FIG. 3A and as shown in FIG. 5 the control pressure of the pressure regulator 33 is held constant even if the return flow rate increases. However, when the engine is stopped and then the engine is started again while it is still hot, at the low control pressure shown between the return flow rates $Q_{min}$ and $Q_{max}$, fuel vapor may arise in the fuel on restarting. When vapor arises in the fuel, the starting characteristics are impaired by the fuel injection quantity from the injectors 14 falling. Because of this, in this preferred embodiment during hot restarting of the engine, temperature information from the water temperature sensor 101 and the like is inputted into the ECU 50, a control signal is outputted from the ECU 50 to the fuel pump controller 32 and the fuel delivery flow rate of the fuel pump 31 is increased. Because the valve body 60 of the pressure regulator 33 is lifted to the position shown in FIG. 3C along with this increase in the fuel delivery flow rate, the control pressure of the pressure regulator 33 shifts to the high-pressure side and is held at the constant pressure as shown in FIG. 5. Because the high-pressure side constant pressure value is more than 0.5 kgf/cm$^2$ different from the low-pressure side constant pressure value and is set at above 3 kgf/cm$^2$, the production of vapor is suppressed by the high fuel supply pressure and consequently hot restarting of the engine can be carried out well. When the high-pressure side constant pressure value is set higher to over 5 kgf/cm$^2$, the production of vapor during hot restarting can be further suppressed.

It is to be understood that, because the change amount of the high-pressure side pressure value is determined to be below 0.1 kgf/cm$^2$/10 liters/hr, the fuel injection amount or air-fuel ratio can be maintained at a desired value and the noxious exhaust gas emission as well as the fuel consumption can be reduced.

It is to be noted that the value, 0.1 kgf/cm$^2$/10 liters/hr, is determined as follows. In view of the necessity for meeting the exhaust gas regulations, the variation (accuracy) in the air-fuel ratio must be maintained within 5% and, for this reason, the variation in the fuel pressure must be maintained within 10%. Since it is established that $P=CQ^2$ (C: constant) with P and Q being pressure and amount of fuel passing through an orifice formed in the seat member 63, the variation in the fuel pressure should be restricted as follows under the condition that the variation in the air-fuel ratio or the fuel injection amount is at 5%.

$$(P_1P_0)/P_0=[(CQ_1)^2-(CQ_0)^2/(CQ_0)^2=(1.05^2-1^2)/1^2=10\%$$

Assuming that the controlled fuel pressure is 3 kgf/cm$^2$, the variation is 3×0.1=0.3 kgf/cm$^2$. The flow amount of fuel at both the high-pressure side and the low-pressure side needs some variation or tolerance of about 20 liters/hr. Therefore, the ratio of the fuel pressure variation to the excess fuel amount variation must be as follows.

$$(0.3\ \text{kgf/cm}^2)/(20\ \text{liters/hr})=0.15\ (\text{kgf/cm}^2/\text{liter/hr})$$

Thus, in consideration of some tolerances, the ratio is desired to be smaller than 0.1 kgf/cm$^2$/liter/hr in order to maintain the accuracy in the air-fuel ratio.

In the first preferred embodiment described above, the control pressure of the pressure regulator 33 is made to a constant high pressure during hot restarting of the engine. However, it is also possible to for example detect a high load state wherein the engine temperature increases and during high load running suppress the, production of vapor by making the control pressure of the pressure regulator to a high constant pressure.

(Second Preferred Embodiment)

Figure 6:
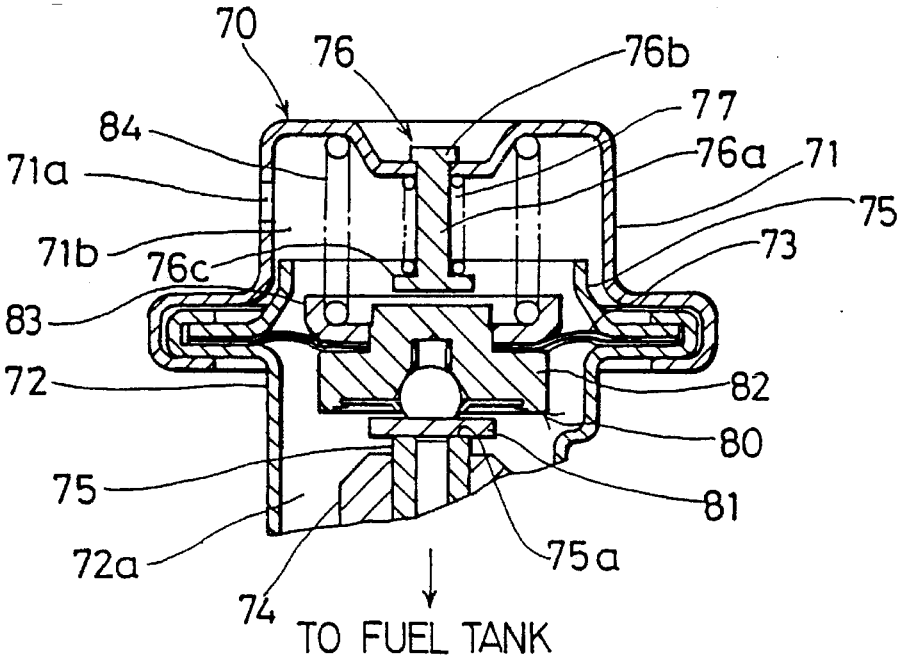
FIG. 6 is a sectional view showing a pressure regulator of a fuel supply system according to a second preferred embodiment of the invention.

A second preferred embodiment of the invention will now be described with reference to FIG. 6.

A pressure regulator 70 comprises a diaphragm 73 having its outer edge portion clamped between a first case 71 and a second case 72. A ventilation hole 71*a* is formed in the first case 71, and a spring chamber 71*b* inside the first case 71 is thereby set at atmospheric pressure or a tank internal pressure. A cylindrical support member 74 is fixed to the second case 72, and a cylindrical seat member 75 is fixed to the inner wall of the support member 74 and projects from the top of the support member 74. A fuel intake pipe and a return pipe not shown in the figure are attached to the side wall of the second case 72.

A rod 76 has at its ends cylindrical engaging portions 76*b* and 76*c* of larger diameters than its shaft portion 76*a*, and the shaft portion 76*a* passes into a concave portion formed in the top of the first case 71. A compression coil spring 77 abuts the top inner wall of the first case 71 and with the engaging portion 76*c* at the end of the rod 76 near a valve part 80, and urges the rod 76 toward the valve part 80.

A valve body 81 of the valve part 80 is held by a valve guide 82 according to a conventional construction, and is abuttable with a valve seat 75*a* of the seat member 75. The valve part 80 is urged toward the seat member 75 by a compression coil spring 84.

When fuel delivered from a fuel pump not shown in the figure enters a fuel chamber 72*a* through an intake pipe not shown in the figure, the diaphragm 73 is pushed toward the side of spring chamber 71*b* against the urging force of the compression coil spring 134, the valve part 80 lifts and the valve body 81 moves away from the valve seat 75*a*. When the valve body 81 lifts together with the valve guide 82, because the valve-opening area formed between the valve body 81 and the seat member 75 increases and the excess fuel return flow rate increases, the control pressure of the pressure regulator 70 is kept constant.

When the fuel delivery flow rate from the fuel pump increases and the valve body 81 lifts, the upper end surface of the valve guide 82 abuts the engaging portion 76*c* of the rod 76. When this happens, because the valve part 80 is urged by the urging forces of the compression coil spring 84 and the compression coil spring 77, the valve body 81 hardly lifts at all. At this time, when the fuel delivery flow rate from the fuel pump increases, the control pressure of the pressure regulator 70 rises.

When the fuel delivery flow rate from the fuel pump increases further, the valve body 81 lifts further again and the control pressure of the pressure regulator 70 is held constant on the high-pressure side.

In this second preferred embodiment also, by providing the compression coil spring 84 and the compression coil spring 77 and thereby making the urging force urging the valve part 80 in its closing direction two-stage and making the degree of lift of the valve body 81 discontinuous, two flat control pressure regions, a high-pressure side and a low-pressure side, are provided in the pressure regulator 70. As a result, as in the first preferred embodiment, the occurrence of vapor during hot restarting or high load running can be suppressed.

(Third Preferred Embodiment)

Figure 7:
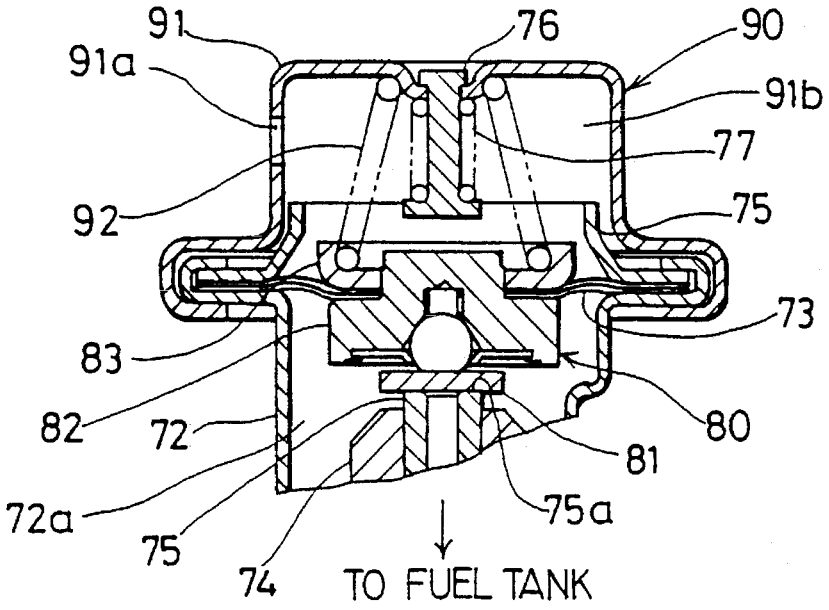
FIG. 7 is a sectional view showing a pressure regulator of a fuel supply system according to a third preferred embodiment of the invention.

A third preferred embodiment of the invention will now be described with reference to FIG. 7.

A ventilation hole 91*a* is provided in a first case 91, and the inside of a spring chamber 91*b* is thereby set at atmospheric pressure or a tank internal pressure. A compression coil spring 92 is conically wound and so constructed that its spring constant increases along with any increase in its degree of deformation.

When fuel delivered from a fuel pump not shown in the figure enters through an intake pipe not shown in the figure, the diaphragm 73 is pushed toward the side of spring chamber 9*b* against the urging force of the compression coil spring 92. The valve part 80 lifts together with the diaphragm 73 and the valve body 81 moves away from the valve seat 75*a* of the seat member 75. When the valve body 81 lifts together with the valve guide 82, because the valve-opening area formed between the valve body 81 and the seat member 75 increases and the excess fuel return flow rate increases, the control pressure of the pressure regulator 90 is kept constant.

When the fuel delivery flow rate from the fuel pump increases further and the valve body 81 lifts further, the spring constant of the compression coil spring 92 increases and the rate of lift of the valve body 81 with respect to the fuel delivery flow rate from the fuel pump decreases. As a result, before the valve guide 82 abuts the rod 76, the control pressure of the pressure regulator 90 starts to increase and the valve guide 82 then abuts the rod 76. When this happens, because the spring constant of the compression coil spring 92 and the spring constant of the compression coil spring 77 are added together and an urging force corresponding to the summed spring constants acts on the valve part 80, the valve body 81 hardly lifts at all and the control pressure rises further.

When the fuel delivery flow rate from the fuel pump increases still further and the pressure inside the fuel chamber 72*a* increases, because the valve body 81 starts to lift again the control pressure of the pressure regulator 90 becomes a high-pressure side constant pressure.

In this third preferred embodiment, the spring constant of the compression coil spring 92 urging the valve part 80 is caused to vary according to the degree of lift of the valve body 81 and the fuel pressure change from a first displacement region to a second displacement region is thereby made smooth by the compression coil spring 92 urging the valve part 80 in its closing direction being wound conically. However, some other spring having a nonlinear spring constant such as a non-constant pitch spring or a tapered coil spring can be used instead of the conical compression coil spring.

Also, in this invention, the occurrence of vapor can be suppressed by adopting a construction which is a combination of constructions shown in the first, second and third preferred embodiments.

In the preferred embodiments of the invention described above, the internal pressure of the spring chamber is set to atmospheric pressure or a tank internal pressure by a ventilation hole being provided in the first case. However, by connecting the inside of an air intake pipe to the spring chamber with a pipe, the spring chamber can alternatively be set at an air intake pipe negative pressure.

It is important that the delivery flow rate from the fuel pump be changeable between a first delivery flow rate sufficient to sustain a fuel consumption flow rate Qm of an ordinary engine running state and a second delivery flow rate sufficient to sustain an excess fuel flow rate Q1 to take the pressure regulator to its second pressure in addition to the fuel supply flow rate Qs to the engine during hot starting, and a fuel pump and control device thereof capable of having its delivery flow rate adjusted in at least two stages and preferably continuously is used.

In the preferred embodiments described above, a diaphragm is used as the pressure-receiving member. This may alternatively be made of a cylindrical, bellows-type member. Also, in the preferred embodiments described above, the pressure regulator has a simple and reliable construction comprising a single pressure-receiving member and a single valve, and the shape of the movable valve member or the urging force of a compression coil spring as urging means is changed so that excess fuel flow rate flowing out in a low-pressure side first region is adjusted to keep the fuel pressure substantially constant at a first pressure and excess fuel flow rate flowing out in a high-pressure side second region is adjusted to keep the fuel pressure substantially constant at a second pressure. However, a two-stage stepped pressure control characteristic may alternatively be realized by providing pluralities of pressure-receiving members and valves.

In the first preferred embodiment, in addition to the flat plate 61 serving as a first valve performing an opening angle adjusting function in a low-pressure side first displacement region and the conical portion 62*b* serving as a second valve performing an opening angle adjusting function in a high-pressure side second displacement region, to provide constriction in the third displacement region between the low-pressure side first displacement region and the high-pressure side second displacement region the valve body 60 is provided with the cylindrical portion 62*a*, positioned in the passage inside the seat member 63 which is the excess fuel outflow passage, for constricting the cross-sectional area of the passage. However, this constriction does not have to be provided on the movable valve member side and may alternatively be provided by suitable shaping of the seat member serving as the fixed valve side.

In the second and third preferred embodiments described above, when the displacement of the pressure-receiving member exceeds a predetermined displacement, the compression coil spring serving as the second urging means acts additionally and the urging force increases and the fuel pressure is raised. However, the combination of a plurality of urging means is not limited to this. For example, by having the second urging means urge the movable valve member in its valve-opening direction until the displacement of the pressure-receiving member exceeds a predetermined displacement the movable valve member can be urged in its valve-closing direction with a small force until the displacement of the pressure-receiving member reaches the predetermined displacement and when the displacement of the pressure-receiving member exceeds the predetermined displacement the movable valve member is urged in its valve-closing direction by a strong force exerted by the first urging means alone.

Alternatively, a single spring with nonlinear characteristics of the kind discussed in the third preferred embodiment may be used to exert a small urging force in the first displacement region of the pressure-receiving member and a large urging force in the second displacement region of the pressure-receiving member.

In the preferred embodiments described above, the pressure regulator is disposed inside the fuel tank or on a wall surface of the fuel tank, and only a one-way fuel pipe for carrying fuel from the fuel tank to the engine is provided. With this construction: [1] Just by controlling a fuel pump of which the fuel delivery flow rate can be changed relatively simply with an electronic operation it is possible to increase the pressure supplied from the pressure regulator from the first pressure to the second pressure and therefore the construction can be made simple. [2] Because fuel heated in the vicinity of the engine is not returned to the fuel tank the occurrence of fuel evaporation can be suppressed. [3] By the pressure regulator supplying the second pressure, vapor of fuel evaporation in the fuel pipe can be reduced, and this is particularly effective during hot restarting and the like. In these preferred embodiments, these advantages [1], [2] and [3] are obtained. However, a pressure regulator according to the invention may alternatively be disposed in the vicinity of the engine.

The present invention may be modified in many other ways without departing from the spirit of the present invention.

What is claimed is:

1. A fuel supply system for engine comprising:

a fuel injector for injecting a predetermined rate of fuel to the engine;

a fuel pump for supplying fuel to the injector;

a pump controller capable of adjusting a fuel delivery flow rate of the fuel pump and increasing the fuel delivery flow rate from the fuel pump during hot restarting of the engine;

a fuel supply passage disposed between the fuel pump and the injector; and a pressure regulator disposed in the fuel supply passage and capable of adjusting a fuel supply pressure to the injector, wherein the pressure regulator is capable of adjusting the fuel supply pressure, according to an excess fuel return flow rate which is a subtraction of the the predetermined rate from the fuel delivery flow rate, to a low-pressure side control pressure region over a first excess fuel flow rate range and to a high-pressure side control pressure region over a second excess fuel flow rate range, and wherein the pressure regulator has, in each of the high-pressure side control pressure region and the low-pressure side control pressure region, a flat control pressure region in which the control pressure varies at less than 0.1 $kgf/cm^2$ per 10 liters/hr.

2. A fuel supply system according to claim 1, wherein the fuel supply passage from the pressure regulator to the injector is closed.

3. A fuel supply system according to claim 1, wherein the pressure regulator is disposed in a fuel tank.

4. A fuel supply system according to claim 1, wherein the difference in pressures between the low-pressure side flat control pressure region and the high-pressure side flat control pressure region is at least 0.5 kgf/cm$^2$.

5. A fuel supply system according to claim 1, wherein the pressure of the high-pressure side flat control pressure region is at least 3 kgf/cm$^2$.

6. A fuel supply system according to claim 1, wherein a valve-opening area of the pressure regulator is caused to vary discontinuously.

7. A fuel supply system according to claim 1, wherein a degree of valve lift of the pressure regulator is caused to vary discontinuously.

8. A fuel supply system according to claim 1, wherein a spring constant with which a valve body of the pressure regulator is urged varies.

9. A pressure regulator of a fuel supply system disposed in a fuel supply passage between a fuel pump and a fuel consuming device for regulating the fuel pressure in the fuel supply passage, the pressure regulator comprising:

a pressure-receiving member which receives the fuel pressure in the fuel supply passage and is displaced according to an excess fuel flow rate corresponding to a difference between a supplied fuel flow rate of fuel supplied from the fuel pump and a consumed fuel flow rate of fuel consumed by the fuel consuming device; and a valve driven according to displacement of the pressure-receiving member to vary a degree of valve-opening thereof for by adjusting an excess fuel flow rate of fuel flowing out of the fuel supply passage, said valve adjusting the fuel pressure in the fuel supply passage to a substantially constant first pressure when the degree of displacement of the pressure-receiving member varies within a first displacement region and adjusting the fuel pressure in the fuel supply passage to a substantially constant second pressure higher than the first pressure when the degree of displacement of the pressure-receiving member varies within a second displacement region higher than the first displacement region.

10. A pressure regulator according to claim 9, wherein the valve continuously changes, in a third displacement region between the first and second displacement regions of the pressure-receiving member, the fuel pressure in the fuel supply passage between the first pressure and the second pressure according to the degree of displacement of the pressure-receiving member.

11. A pressure regulator according to claim 10, wherein the valve has:

a constricting portion positioned in an excess fuel outflow passage for keeping the degree of valve-opening constant in the third displacement region of the pressure-receiving member; and a movable valve member for varying the valve-opening area stepwise according to the displacement of the pressure-receiving member.

12. A pressure regulator according to claim 9, wherein the valve has:

urging means for urging a movable valve member in a valve-closing direction with a stronger force when the pressure-receiving member is in the second displacement region than when the pressure-receiving member is in the first displacement region.

13. A pressure regulator according to claim 12, wherein the urging means has:

first urging means for urging the movable valve member in both the first displacement region and the second displacement region of the pressure-receiving member; and second urging means for urging the movable valve member in either the first displacement region or the second displacement region of the pressure-receiving member.

14. A pressure regulator according to claim 9, wherein the valve controls the amount of change in the fuel pressure in the fuel supply passage to less than 0.1 kgf/cm$^2$ with respect to an amount of change in the excess fuel flow rate of 10 liters/hr, when the fuel pressure in the fuel supply passage is adjusted to the first pressure or to the second pressure.

* * * * *